US009490600B2

(12) United States Patent
Holzapfel

(10) Patent No.: US 9,490,600 B2
(45) Date of Patent: Nov. 8, 2016

(54) HIGH CURRENT SLIPRING FOR MULTI FIBER BRUSHES

(71) Applicant: SCHLEIFRING UND APPARATEBAU GMBH, Füstenfeldbruck (DE)

(72) Inventor: Christian Holzapfel, Füstenfeldbruck (DE)

(73) Assignee: Schleifring Und Apparatebau GmbH (DE)

( * ) Notice: Subject to any disclaimer, the term of this patent is extended or adjusted under 35 U.S.C. 154(b) by 0 days.

(21) Appl. No.: 14/942,347

(22) Filed: Nov. 16, 2015

(65) Prior Publication Data

US 2016/0111839 A1 Apr. 21, 2016

Related U.S. Application Data

(63) Continuation of application No. PCT/EP2013/060268, filed on May 17, 2013.

(51) Int. Cl.

| | |
|---|---|
| ***H01R 39/64*** | (2006.01) |
| ***H01R 39/08*** | (2006.01) |
| *H01R 39/24* | (2006.01) |

(52) U.S. Cl.

CPC ..... *H01R 39/64* (2013.01); *H01R 39/08* (2013.01); *H01R 39/24* (2013.01)

(58) Field of Classification Search

USPC ..... 439/28, 5, 26, 24; 310/248, 237, 232

See application file for complete search history.

(56) References Cited

U.S. PATENT DOCUMENTS

| | | | | | |
|---|---|---|---|---|---|
| 3,329,923 | A * | 7/1967 | Davis | H01R 39/00 | 191/59.1 |
| 4,296,345 | A * | 10/1981 | Haberl | H01R 39/00 | 310/219 |
| 4,398,113 | A * | 8/1983 | Lewis | H01R 39/18 | 310/232 |
| 4,483,574 | A * | 11/1984 | Chabrerie | H01R 39/24 | 310/219 |
| 6,071,125 | A * | 6/2000 | Shiozawa | F16D 27/06 | 310/242 |
| 6,222,297 | B1 * | 4/2001 | Perdue | H01R 39/10 | 29/597 |
| 7,105,983 | B2 * | 9/2006 | Day | H01R 39/381 | 310/238 |
| 7,750,493 | B2 * | 7/2010 | Cairo | F03D 7/0224 | 290/55 |
| 8,167,623 | B2 * | 5/2012 | Schlichtherle | H01R 39/64 | 310/232 |

(Continued)

FOREIGN PATENT DOCUMENTS

| | | | |
|---|---|---|---|
| DE | 1489080 | A | 1/1969 |
| DE | 102011051804 | A1 | 1/2013 |
| EP | 0662736 | A | 7/1995 |

OTHER PUBLICATIONS

The International Search Report and Written Opinion as mailed on Jan. 24, 2014 for International Patent Application No. PCT/EP2013/060268.

*Primary Examiner* — Alexander Gilman

(74) *Attorney, Agent, or Firm* — Yakov Sidorin; Quarles & Brady LLP

(57) ABSTRACT

A slipring comprises a slipring module rotating about a rotation axis, having a plurality of sliding tracks and at least one multi wire brush sliding thereon. The sliding tracks have a circular contact surface with its center located at the rotation axis and a convex shaped cross-section. Due to this convex shaped sliding track, the individual brush wires of the multi wire brush distribute over the sliding track surface and offer a higher number of contact points. This results in a higher current capacity, lower contact resistance and lower contact noise.

13 Claims, 4 Drawing Sheets

(56) References Cited

U.S. PATENT DOCUMENTS 8,616,897 B2 * 12/2013 Angerpointner ..... H01R 39/385
439/24
9,124,055 B2 * 9/2015 Ott ..... H01R 39/24
9,263,838 B1 * 2/2016 Zhang ..... H02K 13/003
2011/0081789 A1 4/2011 Schlichtherle et al.

* cited by examiner

HIGH CURRENT SLIPRING FOR MULTI FIBER BRUSHES

CROSS-REFERENCE TO RELATED APPLICATIONS

This application is a continuation of pending International Application No. PCT/EP2013/060268 filed on 17 May 2013, which designates the United States. The entire disclosure of the International Application is incorporated by reference herein.

FIELD OF THE INVENTION

The invention relates to slip rings for the transmission of electrical signals and/or energy by means of sliding contacts between rotatable parts. In such a sliding contact, a brush is slidable on a sliding track, also called slipring track. The brush and the sliding track comprise electrically conductive materials. The contact between the brush and the sliding track establishes a galvanic connection by which the electric current may be transferred.

DESCRIPTION OF RELEVANT ART

A slip ring is disclosed in DE 14 89 080 A. Here, the brushes comprise solid single wires running in grooves of a track.

Another slip ring is disclosed in EP 0 662 736 A, having multi-wire brushes running in a V-shaped groove of a track. The multi-wire brushes have a plurality of brush wires providing a plurality of simultaneous contacts with the sliding track. This results in a lower contact resistance and a higher current capacity.

US 2011/0081789 discloses a slipring with V-shaped grooves and multi-contact brushes.

SUMMARY

The embodiments are based on the object of providing a slip ring further providing an improved capacity, further reduced contact resistance and contact noise, and further increased current capacity. A further object is to provide a sliding track having improved capacity, further reduced contact resistance and contact noise, and further increased current capacity.

In a first embodiment, a sliding track has a convex shape to provide a better distribution of the brush wires—also called contact wires—of a multi-fiber brush. Preferably, this convex shape protrudes outwards of the surface of a slipring module. Most sliding tracks known from the prior art have concave surfaces formed inwards into the surface of a slipring module, which are designed to guide at least one wire of a brush at a predetermined track. If there is a plurality of brush wires running in a concave sliding track, some of the brushes are directly sliding on the concave track surface, while other wires are located on the top of these sliding wires. These other wires do not establish an electric contact with the sliding track. Test series have shown, that in most cases 20 to 50%, and up to 80% of the available wires are not sliding on the sliding track surface. This is improved by said first embodiment, by using a convex sliding track surface. Here, the individual wires evenly distribute over the surface of the sliding track. If there would be one wire located above another wire, it simply would slide to the side of this other wire and contact the sliding track.

Using a convex sliding track is only useful in conjunction with multi-wire brushes having at least two wires. If there is a plurality of wires, some of the wires are sliding relative to a first side of the center of the track, while others are sliding on the other side of the center of the track. Due to the convex form, there are forces pulling the wires sideward and downwards of the track. As these forces apply to both sides of the center of the track, these compensate and keep the brush as a whole in stable position.

In a further embodiment, there is at least one groove at one side of the convex-shaped sliding track. Preferably, there are two grooves on both sides of the convex-shaped sliding track. These grooves may limit the movement of brush wires. This may further be improved by having at least one side wing and/or elevated side. In a further embodiment, there may be a contact surface, which has at least two convex shape cross-sectioned segments. There may be a plurality of brushes in parallel to each other, each on its own cross-sectioned segment.

The sliding track preferably has a circular shape, which may also be described as an arc segment. The center of the convex sliding track defines a center plane. Preferably, at least one brush is held in the center plane. It is preferred, if the brush is at least essentially parallel to the center plane.

A further embodiment provides a slip ring module comprising at least one sliding track as described herein. Another embodiment provides a slip ring comprising at least one slipring module and at least one multi-wire brush as described herein. Furthermore, it is preferred, if the at least one multi-wire brush includes at least two brush wires and a brush holder for holding the at least two brush wires. Preferably, the at least one multi-wire brush is mounted within a center plane defined by the center of a circular contact surface.

Due to the convex sliding track, there is a better distribution of the brush wires on the sliding track. Tests have shown that more than 90% of the brush wires are in immediate contact with the sliding track. Therefore, by using a sliding track according to the previous embodiments, the number of brush wires staying in sliding contact with the sliding track can be increased without increasing the total number of sliding wires. This leads to an increased current capacity, lower contact resistance and lower contact noise. Furthermore, heat is dissipated over a larger surface and better distributed over the wires and the track surface, which further increases current capacity and lifetime by decreasing wear. Due to the increased current capacity, sliprings may be built smaller. Especially, if there is a high number of sliding wires in an embodiment as known from prior art having a concave sliding track, the wires may shift their location relative to the other wires. This causes additional contact noise. Such a contact noise is prevented by the embodiments described herein.

The sliding tracks and the brush wires mentioned herein most preferably include at least one metal, preferably a noble metal. Such a noble metal may be gold, silver, or an alloy thereof. The sliding track and/or at least one brush wire may have a surface of one of such metals or may be solid of such metals. It is preferred, if the sliding track has a metal body, which may be copper or any copper alloy, or a similar conductive metal material with a surface comprising at least one noble metal. At least one brush may have an inner body of a conductive material, such as steel, brass, or copper, which is coated by a material comprising at least one noble metal. Generally, a brush as mentioned herein includes a plurality of brush wires.

BRIEF DESCRIPTION OF THE DRAWINGS

In the following, the invention will be described by way of example, without limitation of the general inventive concept, on examples of embodiment and with reference to the generally not-to-scale drawings.

Figure 1:
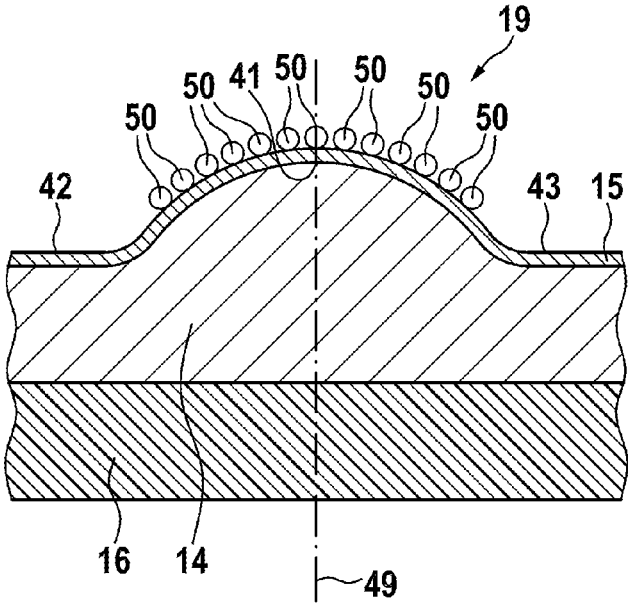
FIG. 1 shows a sectional view of a convex sliding track.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

In FIG. 1, a sectional view of a convex sliding track according to a first embodiment is shown. The sliding track has a sliding track body 14. The sliding track body 14 is held by or embedded into slip ring body 16. To allow a good electric contact with the brushes, there is a sliding track coating 15 at the surface of sliding track body 14. A plurality of brush wires 50 are sliding at the sliding track coating. The sliding track basically has a convex shaped cross-section 19 with a center section 41 defining the center plane 49. Besides this center section, preferably there are side wings 42 and 43, which preferably are also coated as previously described. During normal operation, the wires 50 are sliding on the convex-shaped sliding track portion and do not slide on the side wings. These may provide some safety margin for the case the wires 50 leave their normal position. This may be caused by misalignment, shock, or vibration. The convex sliding track may have a cross-section of a segment of a sphere, an ellipse, a sinus or any other form resulting in a convex shape. In this and the following figures, only a single sliding track is shown. There may also be a plurality of such tracks mounted side by side at a slipring module. The tracks may be connected electrically or may be insulated from each other.

Figure 2:
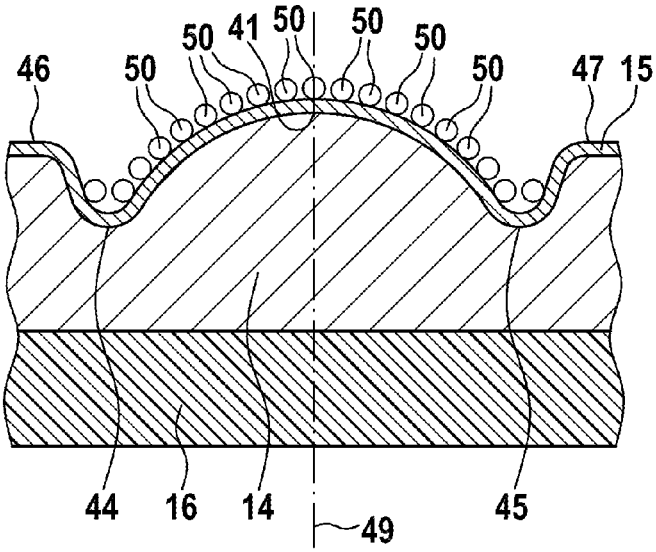
FIG. 2 shows a sectional view of a second embodiment.

In FIG. 2, a sectional view of a second embodiment of a sliding track is shown. Here, side grooves 44 and 45 are configured to catch any brush wires sliding away from the convex-shaped sliding track. Furthermore, elevated sides 46 and 47 may be configured to provide an additional safety margin.

Figure 3:
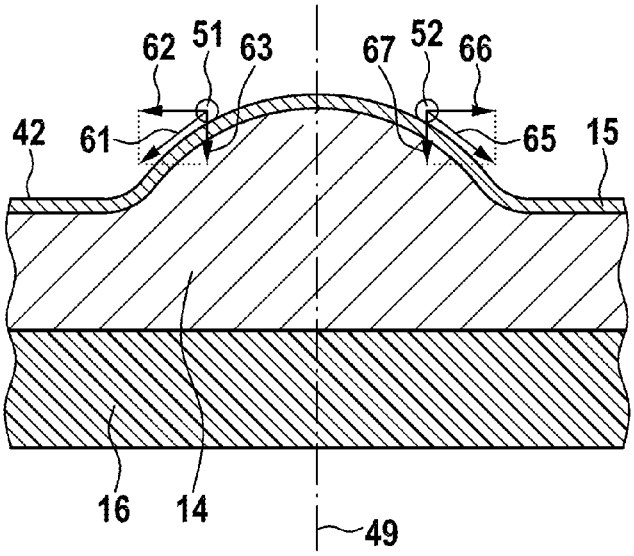
FIG. 3 shows the forces at sliding wires in a sectional view of a sliding track.

In FIG. 3, forces at sliding wires are shown in a sectional view of a sliding track. In this example, only two sliding wires are shown for simplicity. Basically, the same forces apply, if there is a larger number of sliding wires. A first brush wire 51 is shown at the left side of center plane 49, while a second brush wire 52 is shown at the right side of the center plane 49. The forces, which apply to the brushes 51 and 52, are symmetrical to the center plane 49. At the first brush 51, a first tangential force 61 pulls the brush outwards to the left side. This force has two components. A first component 62 pulls the brush at a right angle to the center plane away from the center plane, while a second force 63 presses the brush 51 parallel to the center plane to the sliding track surface. The second force 63 is generated by the elasticity of the brush wire, pressing the brush wires of a brush in the direction of a rotational axis of the slip ring and parallel to the center plane 49. The same applies to the second brush 52 with the tangential force 65, the first force 66, and the second force 67, basically pressing the second brush to the right side. If this arrangement is symmetrical, the first force 62 at brush 51 and the first force 66 at the second brush 52 have the same size and opposite direction. Therefore, these forces compensate each other and allow for a stable positioning of the both brush wires 51 and 52 on the surface of the convex sliding track. To allow for such a compensation of forces, the brushes 51 and 52 preferably are tightly attached and held together in a brush holder.

Figure 4:
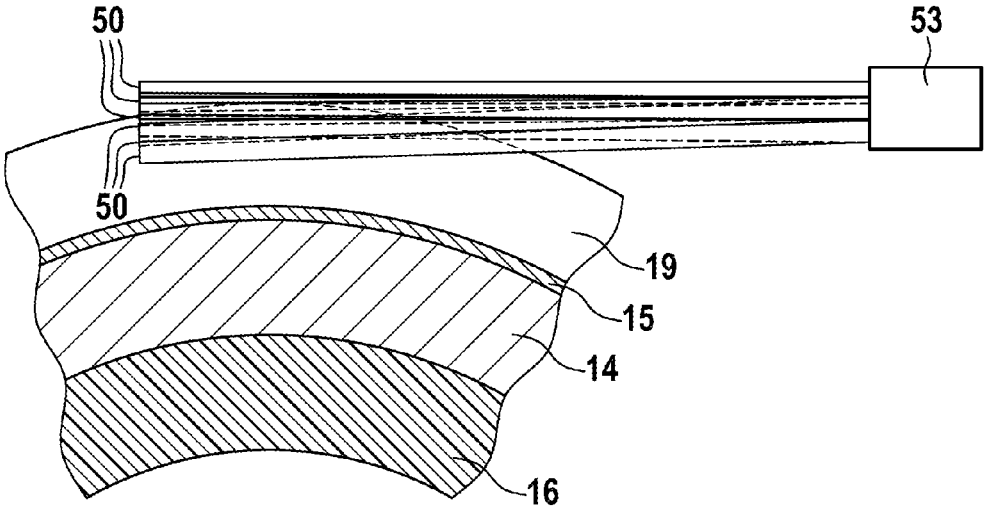
FIG. 4 shows a plurality of brushes held by brush holder in a side view.

In FIG. 4, a plurality of brushes 50 held by a brush holder 53 are shown in a side view. At least a part of the brush holder 53 may be a sleeve, holding all the wires tightly together. Preferably, the brush holder 53 is arranged within the center plane 49 and may be held by the printed circuit board 20 (as shown in FIG. 7) or any other brush holding assembly.

Figure 5:
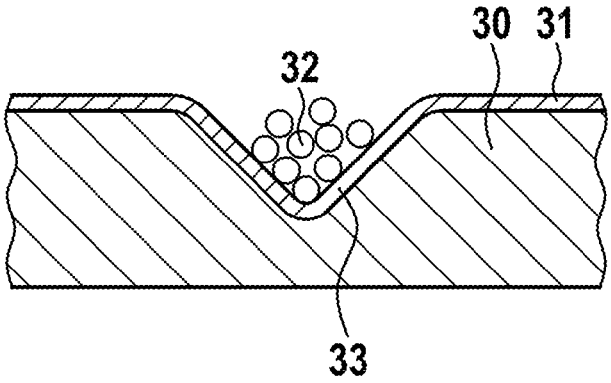
FIG. 5 (PRIOR ART)
FIG. 5 shows a sliding track as known from the prior art.

In FIG. 5, a sliding track as known from the prior art is shown. On a slip ring body 30, there is a sliding track coating 31, forming a V-shaped groove 33. Basically, this is a concave form. There is a plurality of brush wires 32 sliding in this groove. It can be seen, that only some of the brush wires 32 are in electrical contact with the groove, while the other brush wires are located on top of the sliding brush wires.

Figure 6:
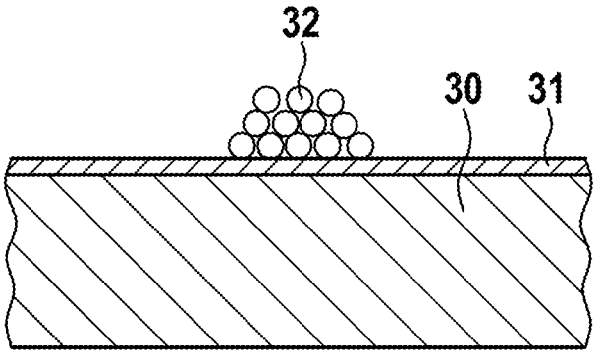
FIG. 6 (PRIOR ART)
FIG. 6 shows another sliding track as known from the prior art.

In FIG. 6, a sliding track as known from the prior art is shown. On a slip ring body 30, there is a sliding track coating 31, forming a flat sliding track. There is a plurality of brush wires 32 sliding on this track. It can be seen, that only some of the brush wires 32 are in electrical contact with the track, while the other brush wires are located on top of the sliding brush wires.

Figure 7:
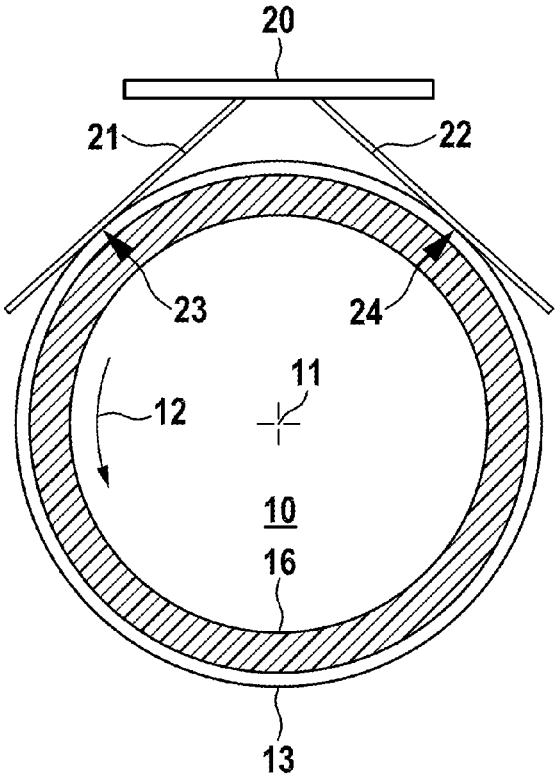
FIG. 7 shows a sectional view of a slip ring.

In FIG. 7, a schematic view of a slip ring is shown in a sectional view. The slip ring has a slip ring module 10, which may be rotatable around a rotation axis 11 in rotation direction 12. It may also be rotated in the opposite direction. The slip ring module has a slip ring body 16, which preferably includes an isolating material, most preferably ceramic, plastic, polymer, or epoxy. There is at least one sliding track 13 held by and/or embedded into the slip ring body 16. A first wire brush 21 and/or a second wire brush 22 may slide on the sliding track 13 and contact the sliding track in the vicinity of a first contact point 23 and a second contact point 24. Preferably, both wire brushes may be held by a printed circuit board 20 or any other kind of brush holding assembly. Instead of the printed circuit board, any other means like a metal plate may be used.

It will be appreciated to those skilled in the art having the benefit of this disclosure that this invention is believed to provide sliprings and brushes therefor. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 slip ring module
11 rotation axis
12 rotation direction
13 sliding track
14 sliding track body
15 sliding track coating
16 slip ring body
19 convex shaped cross-section
20 printed circuit board
21 first wire brush
22 second wire brush
23 first contact point
24 second contact point
30 sliding track body
31 sliding track coating
32 brush wires
33 V-shaped groove
41 sliding track center section
42 first side wing
43 second side wing
44 first side groove
45 second side groove
46 first elevated side
47 second elevated side
49 center plane
50, 51, 52 brush wire
53 brush holder
61, 62, 63 first brush forces
65, 66, 67 second brush forces

What is claimed is:

1. A sliding track (13) of a slip ring module (10), the sliding track (13) being rotatable about a rotation axis (11) and having an outer contact surface, a center of said contact surface located at the rotation axis (11), a cross-section of said contact surface being arctuated outwardly in a convex fashion in a plane parallel to the rotational axis.

2. A sliding track according to claim 1, further comprising at least one side wing (42, 43) on at least one side of the contact surface (19).

3. A sliding track according to claim 1, further comprising two side wings (42, 43) located, respectively, at two sides of the contact surface.

4. A sliding track according to claim 1, further comprising at least one track side groove (44, 45) on at least one side of the contact surface.

5. A sliding track according to claim 1, further comprising two track side grooves (44, 45) located, respectively, at two sides of the contact surface.

6. A sliding track according to claim 1, further comprising at least one elevated side (46, 47) on at least one side of said Contact surface.

7. A sliding track according to claim 1, further comprising two elevated sides (46, 47) located, respectively, at two sides of the contact surface.

8. A sliding track according to claim 1, wherein the contact surface has at least two segments, each of which is arctuated outwardly in a convex fashion.

9. A slip ring module (10) comprising at least one sliding track according to claim 1.

10. A slip ring comprising a slip ring module according to claim 9 and further comprising at least one multi-wire brush (21, 22).

11. A slip ring comprising a slip ring module according to claim 10, wherein the at least one multi-wire brush (21, 22) comprises at least two brush wires (50) and a brush holder (53) configured to hold the at least two brush wires (50).

12. A slip ring comprising a slip ring module according to claim 10, wherein the at least one multi-wire brush (21, 22) is mounted within a center plane (49), the center plane being perpendicular to the rotation axis (11).

13. A slip ring comprising a slip ring module according to claim 10, wherein the at least one multi-wire brush (21, 22) is mounted within a center plane (49) and parallel to a center plane (49), the center plane being perpendicular to the rotation axis (11).

* * * * *